US005988275A

United States Patent [19]

Brady et al.

[11] Patent Number: 5,988,275

[45] Date of Patent: Nov. 23, 1999

[54] METHOD AND SYSTEM FOR SEPARATING AND INJECTING GAS AND WATER IN A WELLBORE

[75] Inventors: Jerry L. Brady; James L. Cawvey; Mark D. Stevenson; John M. Klein, all of Anchorage, Ak.

[73] Assignee: Atlantic Richfield Company, Los Angeles, Calif.

[21] Appl. No.: 09/158,391

[22] Filed: Sep. 22, 1998

[51] Int. Cl.[6] ..... E21B 43/16

[52] U.S. Cl. ..... 166/105.5; 166/105.6

[58] Field of Search ..... 166/265, 105, 166/105.5, 105.6, 169, 306, 369

[56] References Cited

U.S. PATENT DOCUMENTS

| | | | |
|---|---|---|---|
| 4,378,047 | 3/1983 | Elliott et al. | 166/68 |
| 4,531,584 | 7/1985 | Ward | 166/265 |
| 4,531,593 | 7/1985 | Elliott et al. | 175/71 |
| 4,610,793 | 9/1986 | Miller | 210/767 |
| 4,981,175 | 1/1991 | Powers | 166/265 |
| 4,995,456 | 2/1991 | Cornette et al. | 166/51 |
| 5,343,945 | 9/1994 | Weingarten et al. | 166/105.5 |
| 5,385,446 | 1/1995 | Hays | 415/202 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,605,193 | 2/1997 | Bearden et al. | 166/370 |
| 5,730,871 | 3/1998 | Kennedy et al. | 210/512.2 |
| 5,794,697 | 8/1998 | Wolflick et al. | 166/265 |

OTHER PUBLICATIONS

"New Design for Compact Liquid–Gas Partial Separation: Downhole and Surface Installations for Artificial Lift Applications" by J.S. Weingarten, M.M. Kolpak, S.A. Mattison and M.J. Williamson, 1995.

"Development and Testing of a Compact Liquid–Gas Auger Partial Separator for Downhole or Surface Applications" by J.S. Weingarten, M.M. Kolpak, S.A. Mattison and M.J. Williamson, 1997.

"Slim Phase 4™", Sperry–Sun Drilling Services, 1994, 1995.

"New Design Expands Success of Slim Phase 4™ MWD Resistivity Tool", Sperry Sun Drilling Services, Fall 1995.

"Improved Production Log Interpretation in Horizontal Wells Using Pulsed Neutron Logs", by J.L. Brady, J.J. Kohring and R.J. North, 1996.

"Glossary of Terms & Expressions Used in Well Logging", Society of Professional Well Log Analysis, Oct., 1984.

"Jet Pumping" by Hal Petrie, undated.

U.S. application No. 08/906,862, Brady et al., filed Aug. 6, 1997.

U.S. application No. 08/939,359, Brady et al., filed Sep. 29, 1997.

U.S. application No. 09/016612, Brady et al., filed Jan. 30, 1998.

U.S. application No. 09/028,624, Stevenson et al., filed Feb. 24, 1998.

U.S. application No. 09/056,272, Brady et al., filed Apr. 7, 1998.

U.S. application No. 09/170,829, Brady et al., Oct. 13, 1998.

*Primary Examiner*—David Bagnell
*Assistant Examiner*—Sunil Singh
*Attorney, Agent, or Firm*—F. Lindsey Scott

[57] ABSTRACT

A method and system for increasing oil production from an oil well producing a mixture of oil, water, and gas through a wellbore penetrating an oil-bearing formation containing an oil-bearing zone, an aqueous zone, and a gas zone by separating from the mixture of oil, water, and gas in the oil well at least a portion of the water to produce a separated water-enriched portion and a separated oil/gas-enriched portion; driving a turbine with the separated oil/gas enriched portion; driving a water pump and a compressor in the oil well with the turbine; injecting the separated water-enriched portion into a water injection zone; separating from the separated oil/gas-enriched portion in the oil well at least a portion of the gas to produce a separated gas and an the oil-enriched mixture; compressing the separated gas to a pressure greater than a pressure in a gas injection zone to produce a compressed gas; injecting the compressed gas into the gas injection zone; and recovering at least a major portion of the oil-enriched mixture.

7 Claims, 2 Drawing Sheets

METHOD AND SYSTEM FOR SEPARATING AND INJECTING GAS AND WATER IN A WELLBORE

FIELD OF THE INVENTION

This invention relates to a method and system for separating and injecting gas and water in a wellbore and, more particularly, to such a method and system for separating and injecting gas and water in a wellbore to increase the production of oil from oil wells producing a mixture of oil, water, and gas through a wellbore penetrating an oil bearing formation containing an oil bearing zone, an aqueous zone, and a gas cap.

BACKGROUND OF THE INVENTION

In many oil fields the oil-bearing formation comprises a gas cap zone, an oil-bearing zone, and an aqueous zone. Many of these fields produce a mixture of oil, water (i.e., brine), and gas with the ratio of water and gas to oil increasing as the field ages. This is a result of many factors well known to those skilled in the art. Typically the mixture of water, gas, and oil is separated into an oil portion, a water portion, and a gas portion at the surface. The gas portion may be marketed as a natural gas product, injected to maintain pressure in the gas cap, or the like. Further, many such fields are located in parts of the world where it is difficult to economically move the gas to market therefore the injection of the gas preserves its availability as a resource in the future as well as maintaining pressure in the gas cap. The water portion may be injected below, in or above the oil bearing zone to maintain pressure in the oil bearing zone, or passed to suitable treatment and discharged into lakes, rivers, or used for any of a number of purposes that water is commonly used for.

Wells in such fields may produce mixtures having a gas-to-oil ratio (GOR) of over 10,000 standard cubic feet per standard barrel (SCF/STB). In such instances, the mixture may be less than 1% liquids by volume in the well. Typically a GOR from 800 to 2,500 SCF/STB is more than sufficient to carry the oil to the surface as an oil/gas/water mixture. Normally the oil is dispersed as finely divided droplets or as a mist in the gas so produced. In many such wells quantities of water may be recovered with the oil. The term "oil" as used herein refers to hydrocarbon liquids produced from a formation. The surface facilities for separating and returning the gas to the gas cap obviously must be of substantial capacity when such mixtures are produced to return sufficient gas to the gas cap or other formations to maintain oil production.

Typically, in such fields, gathering lines gather the fluids into common lines which are then passed to production facilities or the like where crude oil, condensate, and other hydrocarbon liquids are separated and transported as crude oil. Natural gas liquids may be recovered from the gas stream and optionally combined with the crude oil and condensate. Optionally, a miscible solvent which comprises carbon dioxide, nitrogen and a mixture of light hydrocarbons such as contained in the gas stream may be used for enhanced oil recovery or the like. The remaining gas stream is then passed to a compressor where it is compressed for injection. The compressed gas is injected through injection wells, an annular section of a production well, or the like, into the gas cap.

Some wells may also produce large quantities of water. As the water production (or water cut increases), the fluid column in the well increases in weight and thereby decreases the amount of fluids (oil, water and gas) produced. The increased water production also requires larger surface facilities to handle the produced water. Some wells may produce up to or greater than 90% water.

Clearly the size of the surface equipment required to process the mixture of gas, oil and water is considerable and may become a limiting factor on the amount of oil which can be produced from the formation because of capacity limitations on the ability to handle the produced gas, water or both.

It has been disclosed in U.S. Pat. No. 5,431,228 "Down Hole Gas-Liquid Separator for Wells" issued Jul. 11, 1995 to Weingarten et al and assigned to Atlantic Richfield Company that an auger separator can be used downhole to separate a gas and liquid stream for separate recovery at the surface. A gaseous portion of the stream is recovered through an annular space in the well with the liquids being recovered through a production tubing.

In SPE 30637 "New Design for Compact Liquid-Gas Partial Separation: Down Hole and Surface Installations for Artificial Lift Applications" by Weingarten et al it is disclosed that auger separators as disclosed in U.S. Pat. No. 5,431,228 can be used for downhole and surface installations for gas/liquid separation. While such separations are particularly useful as discussed for artificial or gas lift applications and the like, all of the gas and liquid is still recovered at the surface for processing as disclosed. Accordingly, the surface equipment for processing gas may still impose a significant limitation on the quantity of oil which can be produced from a subterranean formation which produces oil mixed with gas and liquids such as water.

Accordingly, a continuing search has been directed to the development of systems which permit increased amounts of oil to be produced from subterranean formations which produce, mixtures of oil, gas, and liquids such as water.

SUMMARY OF THE INVENTION

According to the present invention, it has been found that increased quantities of oil can be produced from an oil well producing a mixture of oil, water, and gas through a wellbore penetrating an oil-bearing formation containing an oil-bearing zone, an aqueous zone and a gas cap, by separating from the mixture of oil, water, and gas in the oil well at least a portion of the water to produce a separated water-enriched portion and a separated oil/gas-enriched portion; driving a turbine with the separated oil/gas enriched portion; driving a water pump and a compressor in the oil well with the turbine; pumping the separated water-enriched portion into a water injection zone; separating from the separated oil/gas-enriched portion in the oil well at least a portion of the gas to produce a separated gas and an the oil-enriched mixture; compressing the separated gas to a pressure greater than a pressure in the gas cap to produce a compressed gas; injecting the compressed gas into a gas injection zone; and recovering at least a major portion of the oil-enriched mixture.

The present invention also provides a system for increasing the production of oil from a well producing a mixture of oil, water, and gas through a wellbore penetrating a formation containing an oil-bearing zone, an aqueous zone and a gas cap, the system including a first separator positioned in the wellbore in fluid communication with the formation; a pump positioned in the wellbore, drivingly connected to a turbine and having an inlet in fluid communication with a water-enriched mixture outlet from the first separator; a passageway formed in the wellbore, the passageway having an inlet in fluid communication with a water-enriched mixture outlet from the pump, and an outlet in fluid communication with the aqueous zone of the formation; the turbine positioned in the wellbore, the turbine having an inlet in fluid communication with an oil/gas enriched mixture outlet from the first separator; a second separator positioned in the wellbore, the second separator having an inlet in fluid communication with an outlet from the turbine, and having an oil-enriched mixture outlet in fluid communication with a surface; and a compressor positioned in the wellbore, drivingly connected to the turbine, and having an inlet in fluid communication with a gas outlet from the second separator, and a compressed gas discharge outlet in fluid communication with a selected gas injection zone.

DESCRIPTION OF THE PREFERRED EMBODIMENT

In the discussion of the Figures, the same numbers will be used to refer to the same or similar components throughout. In the interest of conciseness, certain well-known components of the wells necessary for the proper operation of the wells have not been discussed.

Figure 1:
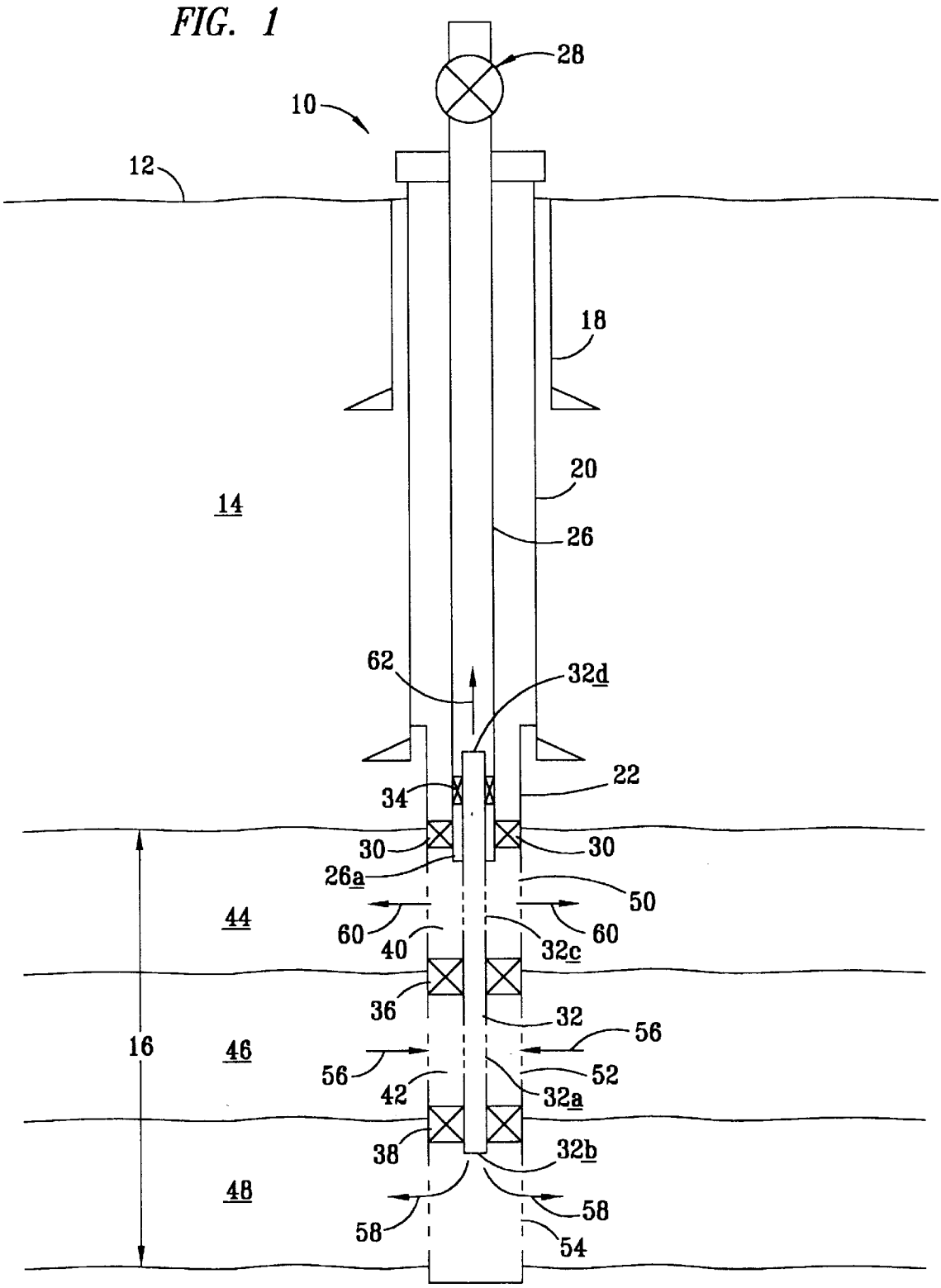
FIG. 1 is a schematic diagram of a production well configured for producing a mixture of oil, gas, and water from a subterranean formation in accordance with the present invention.

In FIG. 1, a production oil well 10 is positioned in a wellbore (not shown) to extend from a surface 12 through an overburden 14 to an oil bearing formation 16. The production oil well 10 includes a first casing section 18, a second casing section 20, and a third casing section 22. The casings are of a decreasing size, and may include more or fewer than three casing sections. The use of such casing sections is well known to those skilled in the art for the completion of oil wells. While the production oil well 10 is shown as a well which extends vertically into the formation 16, it may alternatively be curved to extend at an angle into the formation, or include a section which extends horizontally into the formation. Such variations are well known to those skilled in the art for the production of oil from subterranean formations.

The oil well 10 also includes a tubing string referred to herein as production tubing 26 for the production of fluids from the well 10. The production tubing 26 extends downwardly from a wellhead 28, shown schematically as a valve, toward the formation 16. The wellhead 28 contains the necessary valving and the like to control the flow of fluids into and from the oil well 10, the production tubing 26, and the like. A packer 30 is positioned to prevent the flow of fluids in the annular space between the exterior of the production tubing 26 and the interior of casing sections 20 and 22 above the packer 30.

A tubular member 32 is positioned in a manner well known to those skilled in the art in a lower end 26*a* of the production tubing 26. The positioning of such tubular members by wire line or coiled tubing techniques is well known to those skilled in the art and will not be discussed. The tubular member 32 is secured in position with three packers 34, 36, and 38 or nipples with locking mandrels, which are positioned to prevent the flow of fluids between the outside of tubular member 32 and, respectively, the inside of production tubing 26, a middle portion of the third casing section 22, and a lower portion of the third casing section 22. The tubular member 32 includes an inlet 32*a* for receiving a stream of fluids, and a lower outlet 32*b*, an intermediate outlet 32*c*, and an upper outlet 32*d* for discharging streams of fluids. An upper annular space 40 and a lower annular space 42 are formed laterally between the tubular member 32 and the third casing section 22, and longitudinally between the packers 30 and 36, and between the packers 36 and 38, respectively.

The formation 16 includes a gas cap 44, an oil-bearing zone 46 underlying the gas cap 44, and an aqueous zone 48 underlying the oil-bearing zone 46. Pressure in the formation 16 is maintained by gas in the gas cap 44 and water (i.e., brine) in the aqueous zone 48 and, accordingly, it is desirable in such fields to maintain the pressure in the gas cap and the aqueous zone as hydrocarbon fluids are produced from the formation 16 by injecting gas into the gas cap 44 and/or water into the aqueous zone 48. The injection of gas requires the removal of the liquids from the gas, compressing the gas, and injecting the gas back into the gas cap 44. Typically, the ratio of water and gas to oil recovered from formations, such as the oil bearing formation 16, increases as oil is removed from the formation.

The third casing section 22 is perforated with perforations 50 to provide fluid communication between the annular space 40 and the gas cap 44. The third casing section 22 is further perforated with perforations 52 to provide fluid communication between the annular space 42 and the oil-bearing zone 46. The third casing section 22 is still further perforated with perforations 54 for providing fluid communication between the interior of the third casing section 22 and the aqueous zone 48. The well 10, as shown, produces fluids under the formation pressure and does not require a pump. As will be described in further detail below, fluids may flow from the oil-bearing zone 46, as indicated schematically by arrows 56 into the inlet 32*a* of the tubular member 32. A heavier portion of the fluids (water) is discharged from the tubular member 32 downwardly, as indicated schematically by arrows 58, through the lower outlet 32*b* and the perforations 54 into the aqueous zone 48. A gaseous portion of the fluids is discharged from the tubular member 32 outwardly, as indicated schematically by arrows 60, through the intermediate outlet 32c and the perforations 50 into the gas cap 44. An oil-enriched mixture is discharged from the tubular member 32 upwardly into the production tubing 26, as indicated schematically by an arrow 62, and through the wellhead 28 to processing equipment (not shown) at the surface 12. The apportioning of the flow of fluids between the outlets 32*b*, 32*c*, and 32*d* is achieved in the interior of the tubular member 32 utilizing features of the present invention as will be described below with respect to FIG. 2. It is noted that the producing interval, the gas cap and aqueous formation may be in separate reservoirs and may not be located relative to each other as shown in FIG. 1. In such instances, the water, gas and the oil-enriched mixture, respectively, are passed to the desired formation for injection.

Figure 2:
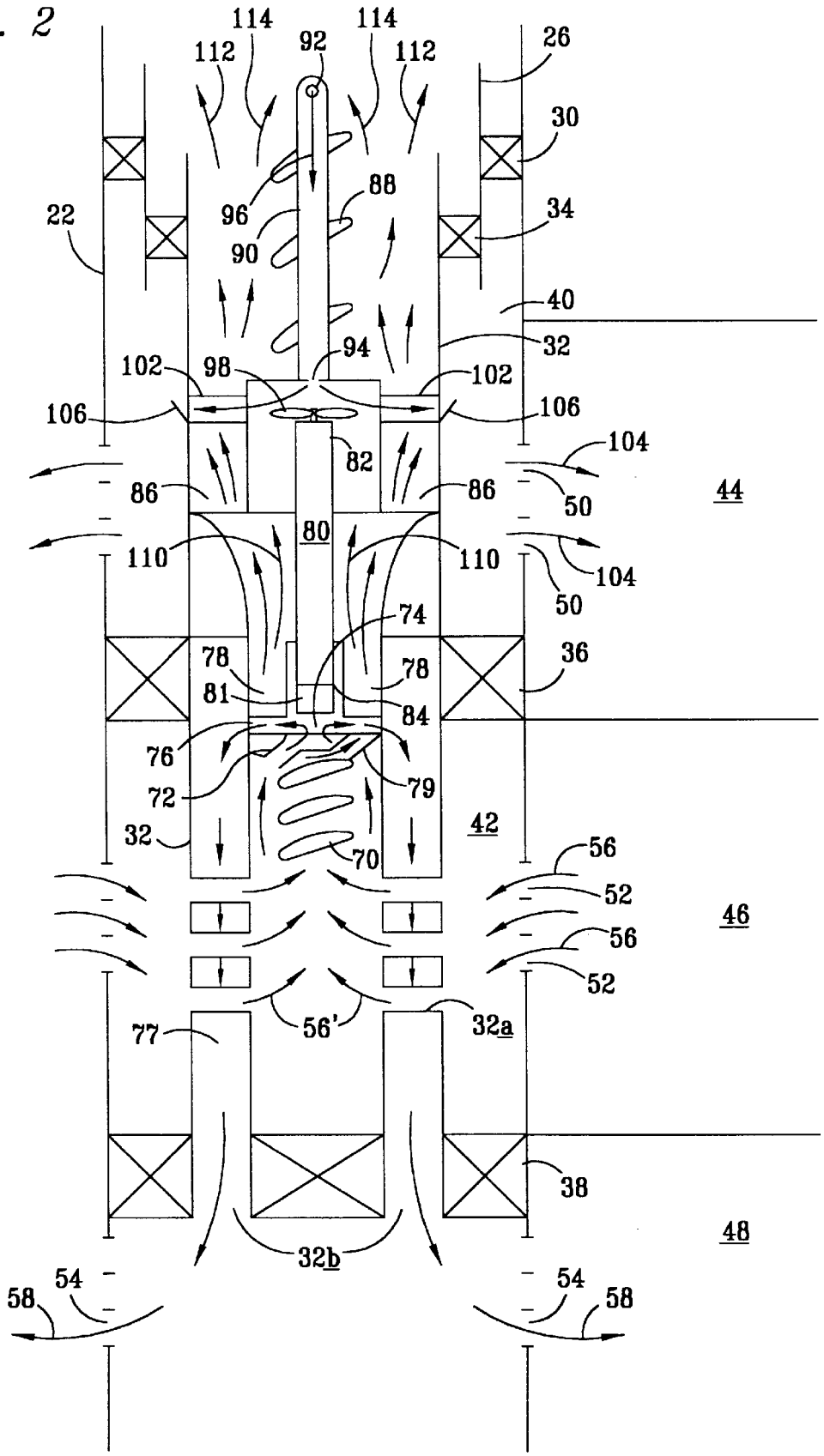
FIG. 2 is a schematic cross-section of an embodiment of an interior portion of a tubular member of the system of FIG. 1.

In FIG. 2, a cross-section of an interior embodiment of the tubular member 32 is schematically shown. As shown therein, a downhole separator 70 such as an auger separator (depicted in FIG. 2), a cyclone separator, a rotary centrifugal separator, or the like, is positioned in the tubular member 32. Auger separators are more fully disclosed and discussed in U.S. Pat. No. 5,431,228, "Down Hole Gas Liquid Separator for Wells", issued Jul. 11, 1995 to Jean S. Weingarten et al, and in "New Design for Compact-Liquid Gas Partial Separation: Down Hole and Surface Installations for Artificial Lift Applications", Jean S. Weingarten et al, SPE 30637 presented Oct. 22–25, 1995, both of which references are hereby incorporated in their entirety by reference. Such separators are considered to be well known to those skilled in the art and are effective to separate lighter phases from heavier phases of a flowing stream of fluids comprising oil, water, and gas by causing the fluids to flow around a circular path thereby forcing heavier phases, e.g., water, outwardly by centrifugal force and upwardly through a separated water-enriched mixture outlet passageway 72 into a pump 74. The pump 74 includes an outlet 76 in fluid communication with an annular passageway 77 configured for directing the flow of water downwardly through the outlet 32*b* and the perforations 54 into a water injection zone, shown as aqueous zone 48, as described below and as shown by arrows 58.

The separator 70 is effective for causing the lighter phases of the mixture, i.e., the oil and gas, to be displaced inwardly within the separator 70, away from the heavier phases, i.e., the water, and through a separated oil/gas mixture outlet 79. The outlet 79 is in fluid communication with an inlet into a turbine 78, shown as a plurality of suitable turbine impeller blades (only two of which are shown) mounted to a shaft 80 to form a suitable turbine. The shaft 80 is rotatably mounted within the tubular member 32 on suitable upper and lower bearings 82 and 84 (not shown), respectively, so that the shaft 80 may rotate when the turbine impeller blades are impinged with fluid received from the separated oil/gas outlet 79. While the turbine 78 is depicted in FIG. 2 as an axial turbine, any of a number of different types of radial or axial turbines, such as a turbine expander, a hydraulic turbine, a bi-phase turbine, or the like, may be utilized in the present invention. Turbine expanders, hydraulic turbines, and bi-phase turbines are considered to be well known to those skilled in the art, and are effective for receiving a stream of fluids and generating, from the received stream of fluids, torque exerted onto a shaft, such stream of fluids comprising largely gases, liquids, and mixtures of gases and liquids, respectively. Bi-phase turbines, in particular, are more fully disclosed and discussed in U.S. Pat. No. 5,385,446, entitled "Hybrid Two-Phase Turbine", issued Jan. 31, 1995, to Lance G. Hays, which reference is hereby incorporated in its entirety by reference. It may be necessary to include a gear box 81 between turbine 78 and pump 74.

A passageway 86 is configured for directing the flow of fluids from the turbine blades 78 to an upper separator 88 positioned in the tubular member 32 above the lower separator 70. The separator 88 is depicted in FIG. 2 as an auger separator, but, like the separator 70, it may comprise a cyclone separator, a rotary centrifugal separator, or the like, effective for separating heavier phases of fluids from lighter phases. The separator 88 includes a central return tube 90 having one or more gas inlets 92 for receiving lighter phases, comprising substantially gases, separated from heavier fluids, comprising substantially an oil-enriched mixture. The central return tube 90, as shown, is hollow and sealed at its top and is thus effective for directing the flow of separated gases received through the inlet 90 in a downwardly direction toward a gas outlet 94 of the central return tube 90.

As further shown in FIG. 2, the central return tube 90 is configured to direct a stream of separated gas received therein downwardly through the gas outlet 94, as indicated schematically by an arrow 96, to a gas compressor 98 shown as impeller blades driven by turbine 78 via turbine shaft 80. While the gas compressor is depicted as a radial compressor, it may be any suitable compressor, such as an axial, radial, or mixed flow compressor, or the like, drivingly connected to the turbine shaft 80. A plurality of discharge outlets 102 (two of which are shown) are configured for carrying compressed gas from the compressor 98 to the annular space 40, and through the perforations 50 into the gas cap 44, as shown schematically by arrows 104. Check valves 106 are optionally positioned over the discharge outlets 102 to prevent fluids from flowing from the gas cap 44 into the compressor 98.

In the operation of the system shown in FIGS. 1 and 2, a mixture of oil, water, and gas flows, as indicated schematically by the arrows 56 from the oil-bearing zone 46, through the perforations 52, and through the inlet 32*a* of the tubular member 32 as shown by arrows 56'. As further shown in FIG. 2, the mixture flows through the inlet 32*a* to the separator 70. The separator 70 separates heavier phases, comprising substantially water, from lighter phases, comprising oil and gas, thereby producing a separated water-enriched mixture and a separated oil/gas-enriched mixture. The separated water-enriched mixture passes into the pump 74 which increases the pressure of the water-enriched mixture to a pressure exceeding the pressure in the aqueous zone 48. The water is then discharged through the passageways 77 through the perforations 54 and into the aqueous zone 48.

The separated oil/gas mixture passes upwardly through the inlet passageway 79 until it impinges the turbine impeller blades 78. As the oil/gas mixture impinges the turbine impeller blades 78, rotational motion is imparted to the turbine impeller blades 78, the shaft 80, the pump 74, and the compressor 98. As the oil/gas mixture flows through the turbine impeller blades 78, the pressure and temperature of the oil/gas mixture decreases, thereby facilitating the separation in the upper separator 88, discussed below, of additional quantities of oil and condensate from the oil/gas mixture. As indicated schematically by arrows 110, the oil/gas portion then flows from the turbine impeller blades 78 upwardly through the passageway 86 to and through the upper separator 88.

As the oil/gas mixture flows through the upper separator 88, it flows in a circular path thereby forcing the heavier phases of the oil/gas portion outwardly by centrifugal force to produce an oil-enriched mixture. The oil-enriched mixture flows upwardly, as shown schematically by the arrows 112, and into the production tubing 26 where it flows to the surface 12 and is recovered through the well head 28 and passed to further gas/liquid separation and the like (not shown). Gas recovered from the produced oil-enriched mixture may then be injected through an injection well, produced as a gas product, or the like.

The heavier phases of the oil/gas portion which, in the upper separator 88, are forced outwardly by centrifugal force, displace the lighter phases, comprising substantially gas, inwardly toward the central return tube 90. The inwardly displaced gas is recovered through the gas inlet 92 of the central return tube 90, as shown schematically by the arrow 114, and is passed downwardly, as shown schematically by an arrow 96, through the tube 90.

Separated gas in the central return tube 90 passes through the gas outlet 94 to the compressor 98. As the separated gas flows through the compressor 98, the gas is compressed to a pressure exceeding the pressure of the gas in the gas injection zone, shown as the gas cap 44. The compressed gas passes through the passageways 102, the check valves 106, into the annular space 40, and, as shown schematically by the arrows 104, through the perforations 50, and into the gas cap 44.

By the use of the system shown in FIGS. 1 and 2, a major portion of the water, which may damage the blades of a downhole turbine, is separated from a stream of production fluids comprising oil, gas and water and injected into a selected formation so that it does not damage the blades of the turbine.

Furthermore, a portion of the gas is removed from the oil/gas mixture and injected downhole without the necessity for passing the separated portion of the gas to the surface for treatment. This removal of a significant portion of the gas downhole relieves the load on surface equipment since a smaller volume of gas is produced to the surface. In many fields, GOR values as high as 25,000 SCF/STB are encountered. GOR values from 800 to 2,500 SCF/STB are generally more than sufficient to carry the produced liquids to the surface. A significant amount of the gas can thus be removed and injected downhole with no detriment to the production process. This significantly increases the amount of oil which can be recovered from formations which produce gas and oil in mixture which are limited by the amount of gas handling capacity available at the surface.

Still further, by the use of the method and device of the embodiment of the present invention, the entire mixture of oil and gas that flows separated from the water in the tubular member 32 is used to drive the turbine blades 78 to provide power for the gas compressor 98 and the water pump 74. As the oil/gas mixture passes through the turbine, the temperature and pressure of the entire mixture is reduced. As a result, additional hydrocarbon components of the mixture of oil and gas are condensed for separation in the separator 88 and can be recovered at the surface 12 as liquids.

The investment to install the system of the present invention in a plurality of wells to reduce the gas and water produced from a field is substantially less than the cost of providing additional separation and compression and water injection equipment at the surface. It also requires no fuel gas to drive the compression and water injection equipment since the pressure of the flowing fluids can be used for this purpose. It also permits the injection of selected quantities of gas and water from individual wells into downhole injection zones. Oil production may thus be increased from wells where oil production had become limited by the capacity of the lines to carry produced fluids away from the well or surface processing equipment. It can also make certain formations, which had previously been uneconomical to produce, economical to produce from because of the ability to inject the gas and water downhole.

Having thus described the present invention by reference to certain of its preferred embodiments, it is noted that the embodiments disclosed are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, what is claimed is:

1. A method for increasing oil production from an oil well producing a mixture of oil, water, and gas through a wellbore penetrating an oil-bearing formation containing an oil-bearing zone, an aqueous zone, and a gas zone, the method comprising:

a) separating from the mixture of oil, water, and gas in the oil well at least a portion of the water to produce a separated water-enriched portion and a separated oil/gas-enriched portion;

b) driving a turbine with the separated oil/gas enriched portion;

c) driving a water pump and a compressor in the oil well with the turbine;

d) pumping the separated water-enriched portion with the water pump into a water injection zone;

e) separating form the separated oil/gas-enriched portion in the oil well at least a portion of the gas to produce a separated gas and an oil-enriched mixture;

f) compressing the separated gas with the compressor to a pressure greater than a pressure in a gas injection zone to produce a compressed gas;

g) injecting the compressed gas into the gas injection zone; and h) recovering at least a major portion of the oil-enriched mixture.

2. The method of claim 1 wherein the step of separating water from the mixture of oil, water, gas is performed using a separator selected from a group of separators consisting of an auger separator, a cyclone separator, and a rotary centrifugal separator; and the step of separating gas from separated oil/gas enriched portion is performed using a separator selected from a group of separators consisting of an auger separator, a cyclone separator, and a rotary centrifugal separator.

3. A system for increasing the production of oil from a production oil well producing a mixture of oil, water, and gas through a wellbore penetrating a formation containing an oil-bearing zone, an aqueous zone and a gas zone, the system comprising:

a) a first separator positioned in the wellbore in fluid communication with the formation;

b) a pump positioned in the wellbore, the pump having an inlet in fluid communication with a water-enriched mixture outlet from the first separator;

c) a passageway formed in the wellbore, the passageway having an inlet in fluid communication with a water-enriched mixture outlet from the pump, and an outlet in fluid communication with a water injection zone;

d) a turbine positioned in the wellbore and drivingly connected to the pump, the turbine having an inlet in fluid communication with an oil/gas enriched mixture outlet from the first separator;

e) a second separator positioned in the wellbore, the second separator having an inlet in fluid communication with an outlet from the turbine, and having an oil-enriched mixture outlet in fluid communication with a surface; and f) a compressor positioned in the wellbore, drivingly connected to the turbine, and having a gas inlet in fluid communication with a gas outlet from the second separator, and a compressed gas discharge outlet in fluid communication with a selected gas injection zone.

4. The system of claim 3 further comprising a gas discharge passageway in fluid communication with the compressed gas discharge outlet from the compressor and in fluid communication with the gas injection zone.

5. The system of claim 3 wherein the gas discharge passageway further comprises a check valve positioned to prevent the flow of fluids from the gas injection zone into the compressor through the gas discharge passageway.

6. The system of claim 3 wherein the turbine, the first separator, the second separator, the compressor, the pump and the passageway are positioned in a tubular member positioned in the wellbore.

7. The system of claim 3 wherein the turbine, the first separator, the second separator, the pump and the compressor are positioned in a tubular member positioned in a tubing string in the wellbore and extending to the surface.

* * * * *